US008591702B2

(12) United States Patent
Sun et al.

(10) Patent No.: US 8,591,702 B2
(45) Date of Patent: Nov. 26, 2013

(54) INCREASING ALKALINE PULPING YIELD FOR SOFTWOOD WITH METAL IONS

(75) Inventors: Yujun Sun, Beaconsfield (CA); Richard McKinnon Berry, Notre-Dame-de-l'lle Perrot (CA); Theodore Radiotis, Laval (CA)

(73) Assignee: FPInnovations, Pointe-Claire, Quebec (CA)

( * ) Notice: Subject to any disclaimer, the term of this patent is extended or adjusted under 35 U.S.C. 154(b) by 24 days.

(21) Appl. No.: 13/133,203

(22) PCT Filed: Dec. 3, 2009

(86) PCT No.: PCT/CA2009/001755

§ 371 (c)(1),
(2), (4) Date: Aug. 10, 2011

(87) PCT Pub. No.: WO2010/066026

PCT Pub. Date: Jun. 17, 2010

(65) Prior Publication Data

US 2011/0284175 A1 Nov. 24, 2011

Related U.S. Application Data

(60) Provisional application No. 61/193,569, filed on Dec. 8, 2008.

(51) Int. Cl.
*D21C 3/20* (2006.01)

(52) U.S. Cl.
USPC ..... 162/76; 162/90

(58) Field of Classification Search
None
See application file for complete search history.

(56) References Cited

U.S. PATENT DOCUMENTS

| | | | |
|---|---|---|---|
| 3,620,911 | A | 11/1971 | Eklund et al. |
| 3,695,994 | A | 10/1972 | Worster et al. |
| 3,841,962 | A | 10/1974 | Procter et al. |
| 3,883,391 | A | 5/1975 | Phillips |
| 3,932,207 | A | 1/1976 | Fogarassy |
| 3,944,463 | A | 3/1976 | Samuelson et al. |
| 4,012,280 | A | 3/1977 | Holton |
| 4,024,229 | A | 5/1977 | Smith et al. |
| 4,159,922 | A | 7/1979 | Cosper |
| 4,338,158 | A | 7/1982 | Bentvelzen |

(Continued)

FOREIGN PATENT DOCUMENTS

| | | |
|---|---|---|
| AU | 56908 73 | 12/1974 |
| AU | 85062 75 | 11/1975 |
| CA | 1196156 | 11/1985 |
| CA | 2049360 | 7/1996 |

OTHER PUBLICATIONS

Clayton, D. Svensk Papperstid. 69(9):311 (1966).
Aurell, R. Tappi 46(4): 209-215 (1963).

(Continued)

*Primary Examiner* — Jacob Thomas Minskey
(74) *Attorney, Agent, or Firm* — Norton Rose Fulbright Canada LLP

(57) ABSTRACT

Impregnating or spraying softwood chips in a solution containing an appropriate concentration of alkaline earth metal ions selected from the group consisting of calcium ions, barium ions and strontium, preferably calcium ions, at room temperature before a reductive alkaline pulping process, for example kraft pulping, significantly increases pulp yield. Using an agent that complexes with the metal ions, such as hydroxyethylidene diphosphonic acid (HEDP) allows this benefit of metal ions to be achieved during the pulping process rather than in a separate impregnation step.

17 Claims, 8 Drawing Sheets

(56) References Cited

U.S. PATENT DOCUMENTS

| | | | | |
|---|---|---|---|---|
| 4,507,172 | A | | 3/1985 | Steltenkamp |
| 5,082,526 | A | | 1/1992 | Dorris |
| 5,441,602 | A | * | 8/1995 | Harris et al. ..... 162/48 |
| 5,552,018 | A | | 9/1996 | Devenyns |
| 5,593,544 | A | | 1/1997 | Fahlgren et al. |
| 7,300,542 | B2 | | 11/2007 | Thompson et al. |

OTHER PUBLICATIONS

Machell, G. Tappi 41(1): 12-16 (1958).
Supplementary European Search Report issued Aug. 19, 2013—EP 09831335.

* cited by examiner

INCREASING ALKALINE PULPING YIELD FOR SOFTWOOD WITH METAL IONS

CROSS-REFERENCE TO RELATED APPLICATIONS

This application is a National entry of PCT/CA2009/001755 filed Dec. 3, 2009, in which the United States of America was designated and elected, and which remains pending in the International phase until Jun. 8, 2011, which application in turn claims priority under 35 USC 119(e) from U.S. Provisional application Ser. No. 61/193,569 filed Dec. 8, 2008.

TECHNICAL FIELD

The present invention relates to a method of increasing pulp yield in reductive alkaline pulping of softwood chips, by use of certain alkaline earth metal ions; it also relates to a process for producing value products from softwood chips.

BACKGROUND ART

Many methods of preserving pulp yield in processes used for the alkaline pulping of lignocellulosic materials have been described. Most of these methods attempt to preserve pulp yield by either reducing or oxidizing the aldehyde end groups of the polysaccharide chains to prevent the alkaline peeling reaction [1]. Sodium borohydride [2], hydrogen sulphide [3], polysulphide [4,5] and anthraquinone [6] are examples of agents that have been used to provide higher yield in alkaline pulping processes.

Calcium hydroxide has been claimed to be able to increase the yield for kraft-AQ pulping [7]. In another claim [8], a portion of the black liquor produced in the pulping process was treated with lime under certain conditions and reused as cooking liquor. The effectiveness of generated polysulphide was enhanced by the carryover of soluble calcium. However in this reported work the function of the calcium was to increase the effect of AQ or PS; no yield increase was observed when calcium was used alone.

Calcium compounds have been proposed to treat hydrocellulose materials with cyanides to increase the yield [9]. It was found that the yield increase was due to the combined presence of cyanide and calcium chloride, and not one of these reagents alone. No indication of an increase in yield by impregnating wood with calcium chloride alone was identified in that work [9].

Calcium has also been proposed to stabilize hydrocellulose structures [10]. The technique is said to decrease the degradation of wood cellulose in a sodium hydroxide refining procedure but not a pulping process.

Although for a completely different purpose, impregnation of lignin solubilising agents, which include alkaline earth metal salts, into chips before pulping has been proposed [11]. However the boiling point of the solvent (a mixture of water and an organic solvent) proposed for impregnation had to be higher than the cooking temperature (160°-180° C.). The possibility of using water without an organic solvent for the impregnation is not described.

The impregnation of magnesium or calcium salts into wood chips in preparation for an oxidative soda-oxygen pulping process has been proposed [12]. The pulping process must be one in the absence of any sulphur form (elemental sulphur or hydrogen sulphide). The oxidative environment in the absence of sulphur makes it possible for the magnesium salt to be used as a protector.

This latter technique differs fundamentally from calcium impregnation followed by a reductive alkaline pulping, for example, a kraft pulping process which requires the presence of various forms of sulphur. Impregnation with a magnesium salt has a negative effect on yield in a reductive alkaline pulping process such as kraft.

SUMMARY OF THE INVENTION

This invention seeks to increase pulp yield in reductive alkaline pulping of wood chips, more especially softwood chips.

This invention also seeks to increase pulp yield as aforesaid, while inhibiting formation of an insoluble scale on the walls of a reaction vessel used for pulping.

Further the present invention seeks to increase the yield from the reductive alkaline pulping of softwood species by a pre-impregnation process.

Still further the present invention seeks to increase the yield from the reductive alkaline pulping of softwood species by adding certain alkaline earth metal ions in the impregnation liquor.

The present invention also seeks to increase the yield from the reductive alkaline pulping of softwood species by spraying chips before pulping.

The present invention also seeks to increase the yield from the reductive alkaline pulping of softwood species by adding certain alkaline earth metal ions in the spray liquor.

The present invention also seeks to increase the yield from the reductive alkaline pulping of softwood species by adding certain alkaline earth metal ions made soluble with a complexing agent in the cooking liquor without using an impregnation stage. In the present invention the alkaline earth metal ions are selected from barium, strontium and calcium ions, preferably calcium ions.

Thus the present invention seeks to increase the yield from the reductive alkaline pulping of softwood species by using barium, strontium or calcium ions.

The present invention also seeks to prevent the scaling in alkaline earth metal salt, especially calcium salt pre-treated reductive alkaline pulping of softwood by adding a complexing agent such as hydroxyethylidene diphosphonic acid (HEDP) and alkaline earth metal salt together in the impregnation liquor.

Furthermore the present invention seeks to increase the yield from acid pre hydrolyis kraft cooking processes of softwood species by using soluble alkaline earth metal ions in an impregnation stage after acid hydrolysis or using complexed alkaline earth metal ions during the reductive alkaline cooking.

In one aspect of the invention, there is provided a method for increasing pulp yield in reductive alkaline pulping of wood chips, comprising: introducing alkaline earth metal ions selected from the group consisting of calcium ions, barium ions and strontium, into said wood chips.

In a particular embodiment of the invention, there is provided a method of producing pulp from wood chips in which the wood contains glucomannan. The method comprises: digesting the wood chips in a reductive alkaline pulping liquor in a reaction vessel to form pulp, in the presence of alkaline earth metal ions selected from the group consisting of calcium ions, barium ions and strontium ions and in the presence of a complexing agent for said ions, which prevents formation of insoluble salts of the alkaline earth metal ions; said alkaline earth metal ions stabilizing the glucomannan of the wood; and said complexing agent inhibiting formation of an insoluble scale on walls of the reaction vessel.

In a further particular embodiment, there is provided a process for producing value products from softwood chips comprising: subjecting softwood chips to acid hydrolysis to produce hydrolyzed softwood chips and a hemicellulose, recovering the hemicellulose, introducing alkaline earth metal ions selected from the group consisting of calcium ions, barium ions and strontium ions into the hydrolyzed softwood chips and pulping the chips under reductive alkaline conditions to produce a pulp in which the alkaline earth metal ions stabilize the glucomannan within the softwood chips against alkali degradation thereby enhancing pulp yield.

DETAILED DESCRIPTION OF THE INVENTION

Figure 1:
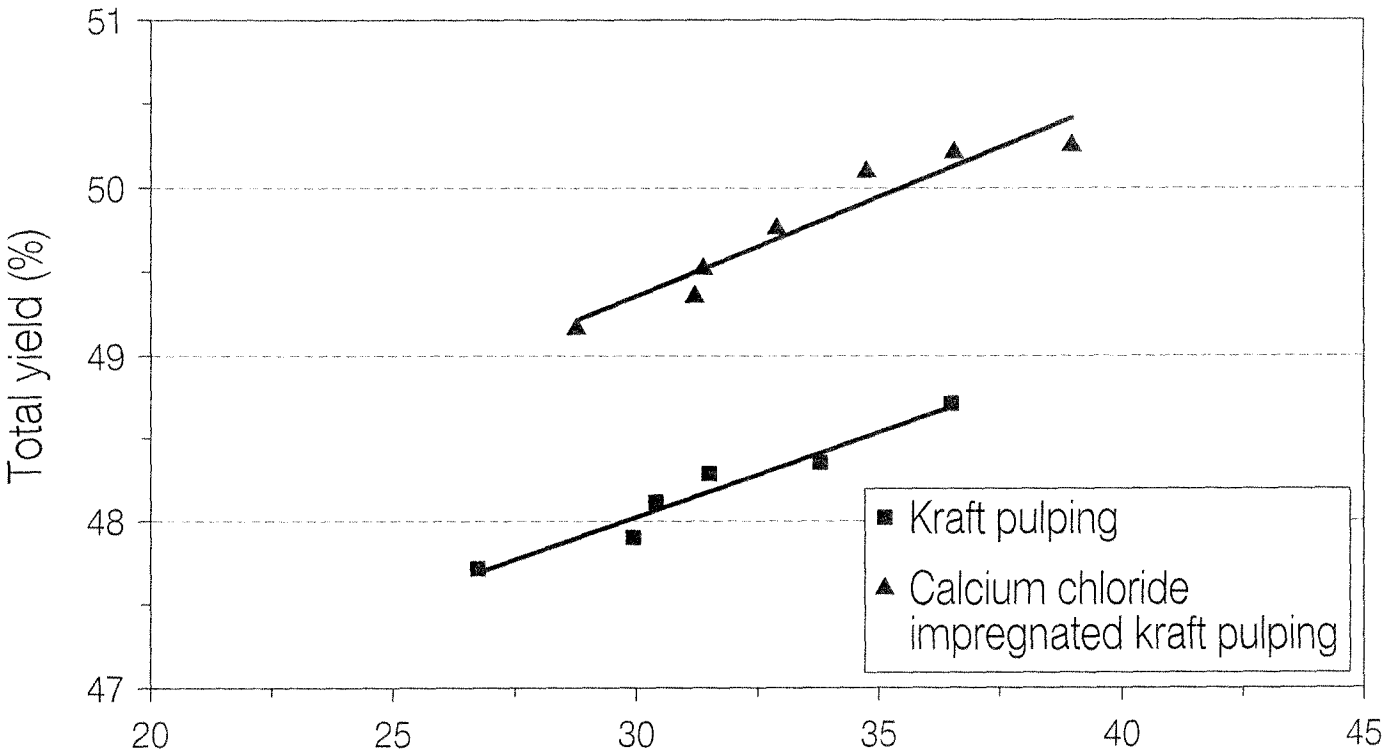
FIG. 1 shows a comparison of the pulping yield (% on oven dried wood) for kraft pulping processes with and without calcium chloride (1.1 g/L as Ca) in a pre-impregnation stage; impregnation was done at room temperature for 16 hours.

The invention is particularly described hereinafter, for convenience, by reference to the preferred embodiments employing calcium ions, but as indicated hereinbefore, barium ions and/or strontium ions can be employed instead of calcium ions. It will be understood that the invention may employ mixtures of two or three of the aforementioned alkaline earth metal ions.

The invention relates to the use of calcium ions in the impregnation of chips prior to reductive alkaline pulping processes of softwood species. To obtain the full yield enhancing effect, any water soluble calcium salt can be applied at a concentration of at least 1.1 g Ca/L in an impregnation liquor, or, at a concentration of at least 3.6 g/L in a spray liquor. The native calcium in the wood can also be used as part of the calcium source. Barium and strontium can be used instead of calcium but magnesium does not produce the same yield enhancing effect.

The same benefit can be achieved by adding calcium salt to the pulping liquor without impregnation or spraying, but a complexing agent such as hydroxyethylidene diphosphonic acid (HEDP) is needed to keep the calcium soluble and prevent the formation of calcium carbonate. The approach of using a complexing agent has a second benefit of preventing possible scaling on the equipment used in the reductive alkaline pulping process.

Impregnating or spraying softwood chips with calcium ions in solution at room temperature before reductive alkaline pulping or, adding calcium ions with an agent that complexes with calcium such as HEDP directly into cooking liquor, significantly increases the pulping yield. The increase in yield appears to be caused by calcium stabilization of the glucomannan structure of the wood towards alkali degradation. Softwood contains about 20%, by weight, of glucomannan in the cellulose, whereas hardwood contains only about 2%, by weight. The association between alkaline earth metal ions such as calcium ions and glucomannan is much stronger than that between alkaline earth metal ions and lignin. In softwood the strong association between alkaline earth metal ions such as calcium ions and glucomannan aggregates the glucomannan, and preserves the pulping or cooking yield. In a hardwood alkaline earth metal ions such as calcium ions associate with lignin causing lignin coagulation which both reduces the pulping or cooking rate and the pulping or cooking yield. Since glucomannan is present only in low content in hardwood any benefit obtained by association between alkaline earth metal ions such as calcium ions and the glucomannan content of the hardwood is offset by the negative affect on the lignin content of hardwood.

In U.S. Pat. No. 3,883,391 [9] mentioned hereinbefore, the hydrocellulose which is being treated does not have a glucomannan structure and so the use of calcium ions alone would not provide the benefit of the present invention.

The impregnation or spraying process requires treatment of softwood chips with a solution of calcium ions. Enough time needs to be given for diffusion of calcium ions into the softwood structure; the pre-treatment can be achieved in as little as 15 minutes at ambient temperature. The time for diffusion is decreased as the impregnation or spraying temperature is increased. The full yield improvement can be achieved with as little as 1.1 g/L (Ca) in the impregnation stage, or 3.6 g/L (Ca) in the spraying stage. In this form of the invention, the liquor needs to remain at a pH at which the calcium will remain soluble for the time required for diffusion into the chips to be completed. The process also works with calcium that is already in the chips. This calcium can be solubilized by adding a mineral or organic acid or generating an acid within the chips, for example, by increasing the temperature to release wood acids. Once the pre-treatment is completed, the pulp can go through the conventional steps of any alkaline pulping processes and provide a yield benefit.

Thus, the introduction of the calcium or other alkaline earth metal ions, in accordance with the invention, into the wood chips may be achieved by solubilizing a calcium content of the wood chips.

Figure 2:
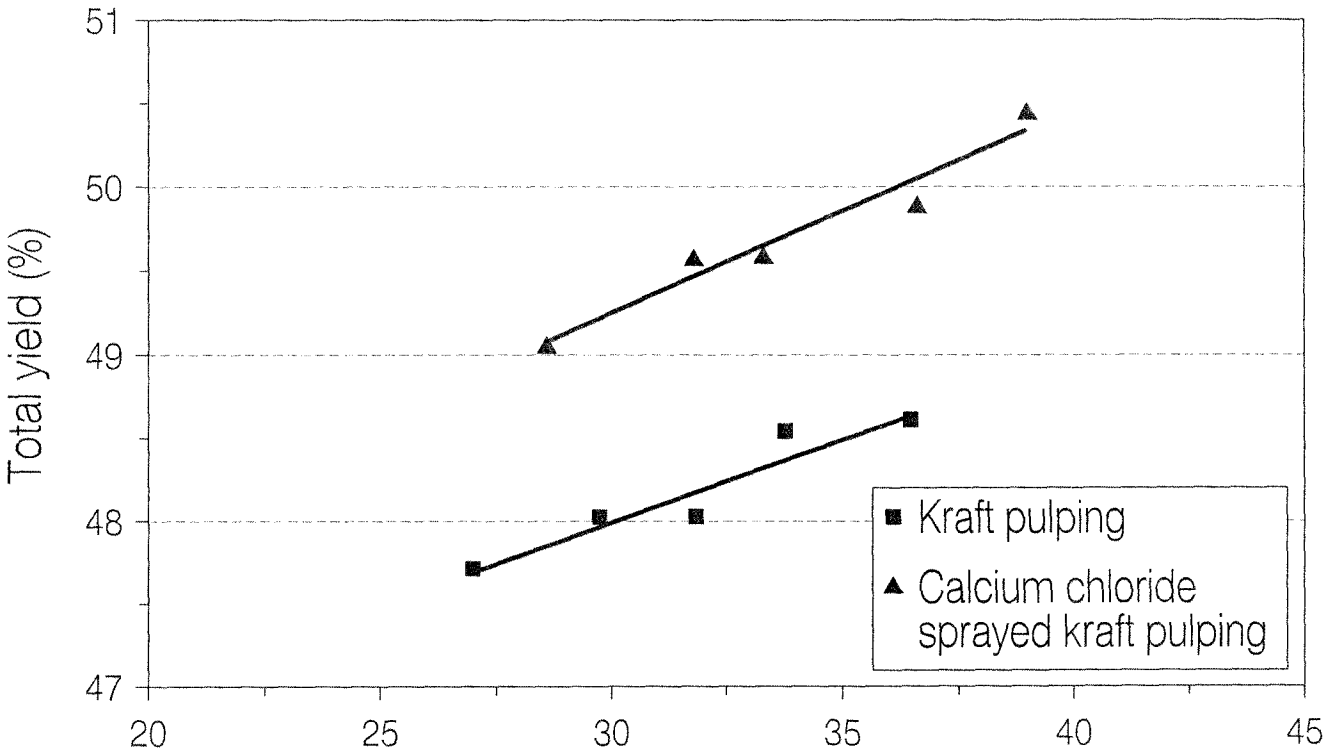
FIG. 2 shows a comparison of the pulping yield (% on oven dried wood) for kraft pulping processes with and without calcium chloride (3.6 g/L as Ca) which was sprayed onto the chips before pulping; spraying was done at room temperature 15 minutes prior to kraft pulping.
Figure 3:
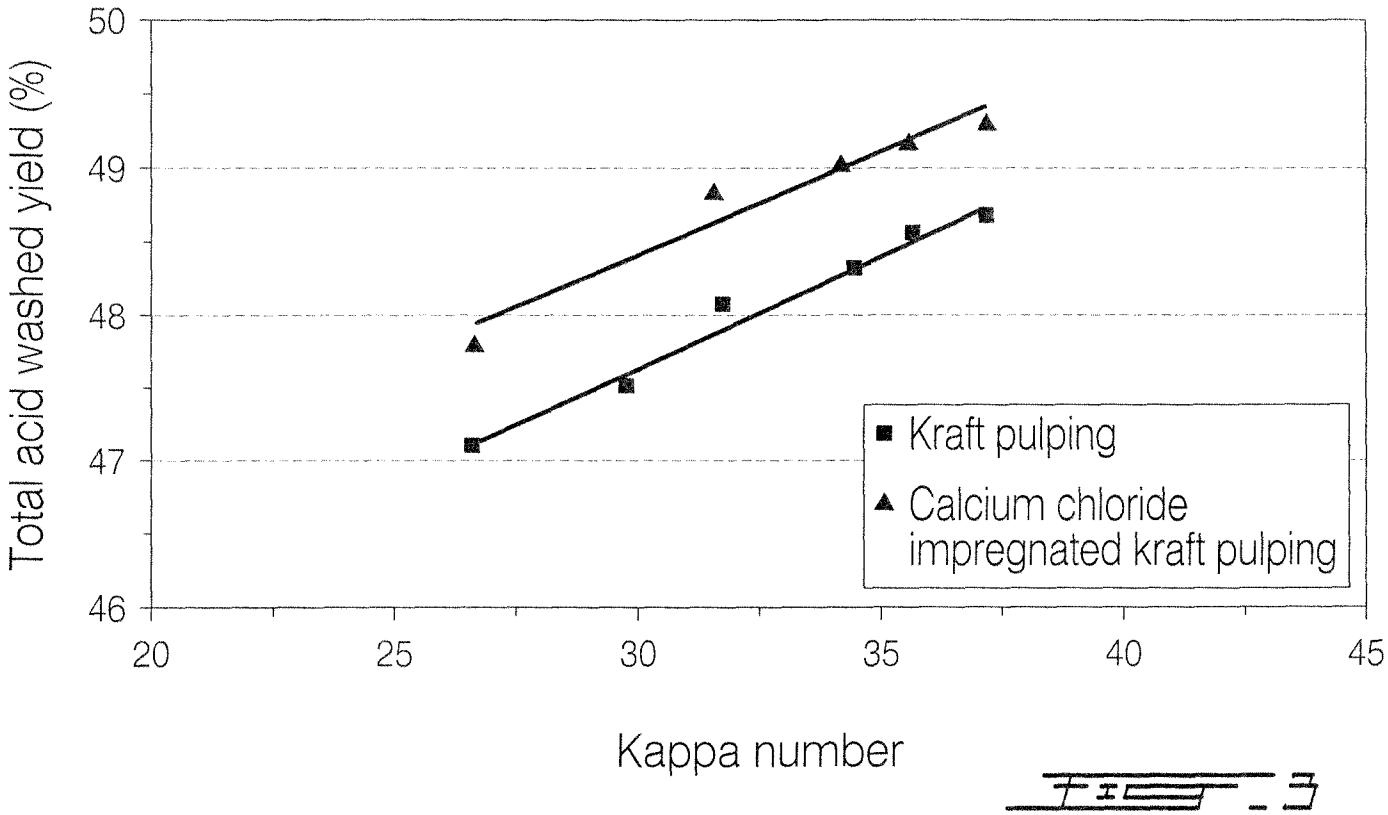
FIG. 3 shows a comparison of the pulping yield (% on oven dried wood) after acid washing for kraft pulping processes with and without calcium chloride (1.1 g/L as Ca) in a pre-impregnation stage; impregnation was done at room temperature for 16 hours.

The cooking yield seen in FIG. 1 (Example 1) and FIG. 2 (Example 2) were measured without a post-pulping acid wash, Without an acid wash, the Ca content in the calcium ion impregnated pulp or calcium ion sprayed pulp are more than that in the conventional kraft pulp (Table I). The added calcium contributes about 0.3% on wood to the total yield. FIG. 3 shows however that, if a post-pulping acid wash is used, there is still a 1.0% yield increase on wood. Therefore, the yield benefits evident after pulping in Examples 1 and 2 are partly due to calcium in the pulp but mainly due to the protection of glucomannan. In unbleached pulping operations, the full increase in yield will be delivered. In bleached pulping operations where acid bleaching stages are used only the portion of the yield increase provided by glucomannan stabilisation will be delivered. The protection provided by calcium is further evidenced in Examples 3 through 8. In these examples, an acid treatment is used before yield determination to ensure that the Ca content in the control and the treated pulps are similar (Table I). Examples 3 through 8 show a significant yield benefit even after calcium removal.

TABLE I

Ca in various pulp samples after kraft cooking with and without acid treatment

| Pulping process | Pulp treatment | Ca content (mg/kg) | Na content (mg/kg) |
|---|---|---|---|
| Kraft | No acid washing | 1,371 | 965 |
| Ca impregnated Kraft | No acid washing | 7,315 | 481 |
| Kraft | Acid washed | 179 | 1650 |
| Ca impregnated | Acid washed | 153 | 1,790 |

Figure 4:
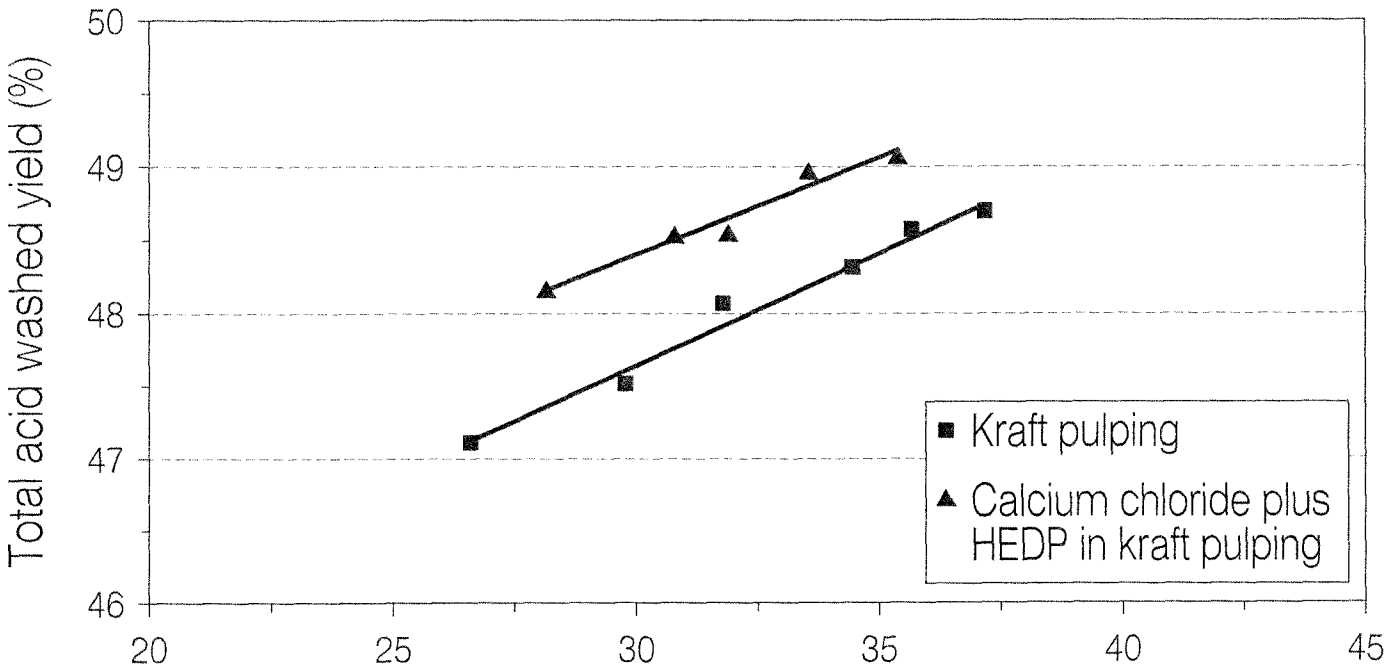
FIG. 4 shows a comparison of the pulping yield (% on oven dried wood) after acid washing for kraft pulping processes with and without the addition of calcium chloride (3 g) plus hydroxyethylidine diphosphonic acid (HEDP) (0.4 g, active acid form)

A second approach to achieving the same result is to add a calcium salt directly into the reductive alkaline pulping liquor as a soluble complex which allows the elimination of the impregnation stage. The calcium complex has to be stable enough to prevent carbonate, which is normally present in the cooking liquor, reacting with the calcium to form an insoluble calcium carbonate precipitate. One example of a suitable complexing agent is hydroxyethylidenediphosphonate (HEDP) which can be added with a soluble calcium salt into the cooking liquor to avoid the formation of calcium carbonate. FIG. 4 shows that the soluble complexed calcium ion in pulping liquor is as effective as the soluble uncomplexed calcium ion in an impregnation stage in protecting glucomannan during cooking and providing an increase in yield.

A further advantage of using a complexing agent such as HEDP, which can be used directly in the pulping process or in the impregnation stage, is that it can be ensured that all the calcium will be complexed either with the complexing agent (HEDP) or glucomannan. Concerns about possible scaling are therefore eliminated.

Thus, in accordance with the invention, the wood chips may be impregnated or sprayed with the alkaline earth metal ions prior to the reductive alkaline pulping; or the reductive alkaline pulping may be carried out in a pulping liquor containing the alkaline earth metal ions in solution and the ions may be maintained in solution by a complexing agent for the ions; or the ions may be introduced in the wood chips, by solubilizing an alkaline earth metal content of the wood chips, especially a calcium content, to provide the ions.

The invention can work with any reductive alkaline pulping process. The invention will be of particular utility in softwood pulping processes that use a prehydrolyis stage with the goal of producing a hemicellulose stream for value added chemicals—the biorefinery concept—while still wanting to provide a good papermaking pulp. The reintroduction of calcium after acid hydrolysis will be beneficial for retaining glucomannan during the subsequent reductive alkaline pulping portion of the cooking process.

The alkaline earth metal ions that can be employed are the soluble salts of the alkaline earth metals, for example, acetate, bromide, bisulfite, and thiosulfate of calcium, barium or strontium. Magnesium ions do not work in this invention.

The ions are employed in aqueous solutions in water, and organic solvents are not required, as such, the ion solutions are suitably free of organic solvents, The pulping of the chips under reductive alkaline conditions to produce a pulp, is in particular a Kraft pulping process.

EXAMPLES

Example 1

Wood chip preparation: Wood chips of black spruce were classified and the 2 to 8 mm fraction was used. Chips containing any visible knots or bark were removed manually. The chips were passed through a steaming-soaking process twice, each pass included three cycles of steaming (3 minutes each time at 138 kPa), cooling to develop vacuum for 5 minutes and soaking in deionised water for 15 minutes.

Impregnation: The chips (200 g o.d. basis) were impregnated in 1.8 L of deionised water (for control samples) or calcium chloride solution (1.1 g/L of Ca) at room temperature for the chosen time. The impregnation liquor was drained over 10 minutes to remove the excess liquor prior to kraft pulping.

Kraft cooking: Pulping was done in 6 2 L stainless steel pressure vessels at 170° C. and with a time-to-temperature of 90 minutes. The active alkali charge, sulphidity and $Na_2CO_3$ content were 18% (o.d. wood), 30% and 15.9 g/L respectively. The L/W ratio was 4.0 (including chip moisture).

Pulping yield determination: When the predetermined H-factor of pulping was reached, the pulp was disintegrated and well washed with deionised water on a 450-mesh screen. After soaking in deionised water for 18 hours, the pulp was centrifuged and then homogenised. The yield determination was made by weighing the wet pulp and measuring the moisture of the sample.

By impregnating chips with calcium chloride solution (1.1 g/L of Ca), the kraft pulping yield was increased by between 1.2% and 1.4% on wood at the same target kappa number in the kappa range of 26 to 40. (FIG. 1)

Example 2

Wood chip preparation: Same as in example 1.

Spraying step: Calcium chloride solution (150 mL) with a concentration of 3.6 g/L (Ca) was sprayed onto chips (200 g o.d. basis) at room temperature. A minimum of 15 mins was waited prior to kraft pulping.

Kraft cooking: Same as in example 1

Pulping yield determination: Same as in example 1

By spraying chips with calcium chloride solution (3.6 g/L of Ca), the kraft pulping yield was increased by between 1.2% and 1.4% on wood at the same target kappa number in the kappa range of 27 to 40. (FIG. 2)

Example 3

Wood chip preparation: Same as in example 1.

Impregnation: Same as in example 1

Kraft cooking: Same as in example 1

Pulping yield determination: When the predetermined H-factor of pulping was reached, the pulp was disintegrated and well washed with deionised water on a 450-mesh screen.

After soaking in deionised water for 18 hours, the pulp was: brought to 0.66% consistency, adjusted to pH 2 using $H_2SO_4$ (1N), kept at pH 2 for 10 minutes, drained and washed on a 450-mesh screen. The pulp was then brought back to 0.66% consistency, adjusted to pH 9 using NaOH (1N), kept at pH 9 for 10 minutes, drained and washed on a 450-mesh screen. The pulp was finally centrifuged and homogenised before yield determination. The yield determination was made by weighing the wet pulp and measuring the moisture of the sample.

By impregnating chips with calcium chloride solution (1.1 g/L of Ca), the kraft pulping yield after acid washing was increased by between 0.6% and 0.8% on wood at the same target kappa number in the kappa range of 26 to 37. (FIG. 3)

Example 4

Wood chip preparation: Same as in example 1.

Impregnation: No

Kraft cooking: Before cooking, HEDP (0.4 g, active acid form) and $CaCl_2$ (3 g) were added directly into the cooking liquor. The cooking procedure was the same as in example 1.

Pulping yield determination: Same as in example 3

By adding calcium chloride (3 g) and HEDP (0.4 g, active acid form) into the kraft cooking liquor, the acid washed kraft pulping yield was increased by between 0.6% and 0.8% on wood at the same target kappa number in the kappa range of 28 to 36 (FIG. 4).

Example 5

Wood chip preparation: Same as in example 1.

Impregnation: The chips (200 g o.d. basis) were impregnated in 1.8 L of deionised water for the control samples or in calcium acetate solution (1.1 g/L of Ca) at room temperature for 16 hours. The impregnation liquor was drained over 10 minutes to remove the excess liquor prior to kraft pulping.

Kraft cooking: Same as in example 1

Pulping yield determination: Same as in example 3

Figure 5:
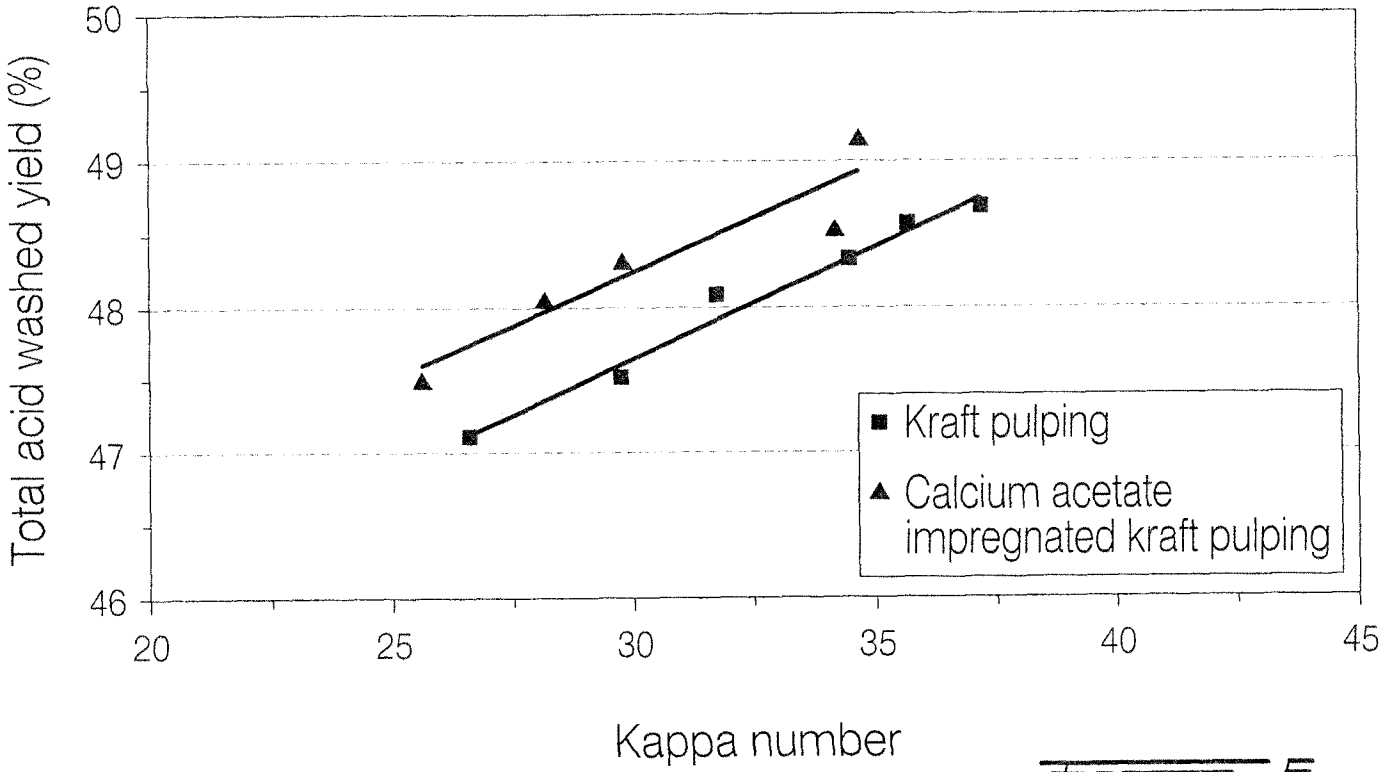
FIG. 5 shows a comparison of the pulping yield (% on oven dried wood) after acid washing for kraft pulping processes with and without calcium acetate (1.1 g/L as Ca) in a pre-impregnation stage; impregnation was done at room temperature for 16 hours.

By impregnating chips with calcium acetate solution (1.1 g/L of Ca), the acid washed kraft pulping yield was increased by between 0.6% and 0.7% on wood at the same target kappa number in the kappa range of 26 to 38 (FIG. 5).

Example 6

Wood chip preparation: Same as in example 1.

Impregnation: The chips (200 g o.d. basis) were impregnated in 1.8 L of deionised water for the control samples or in barium chloride solution (1.1 g/L of Ba) at room temperature for 60 minutes. The impregnation liquor was drained over 10 minutes to remove the excess liquor prior to kraft pulping.

Kraft cooking: Same as in example 1

Pulping yield determination: Same as in example 3

Figure 6:
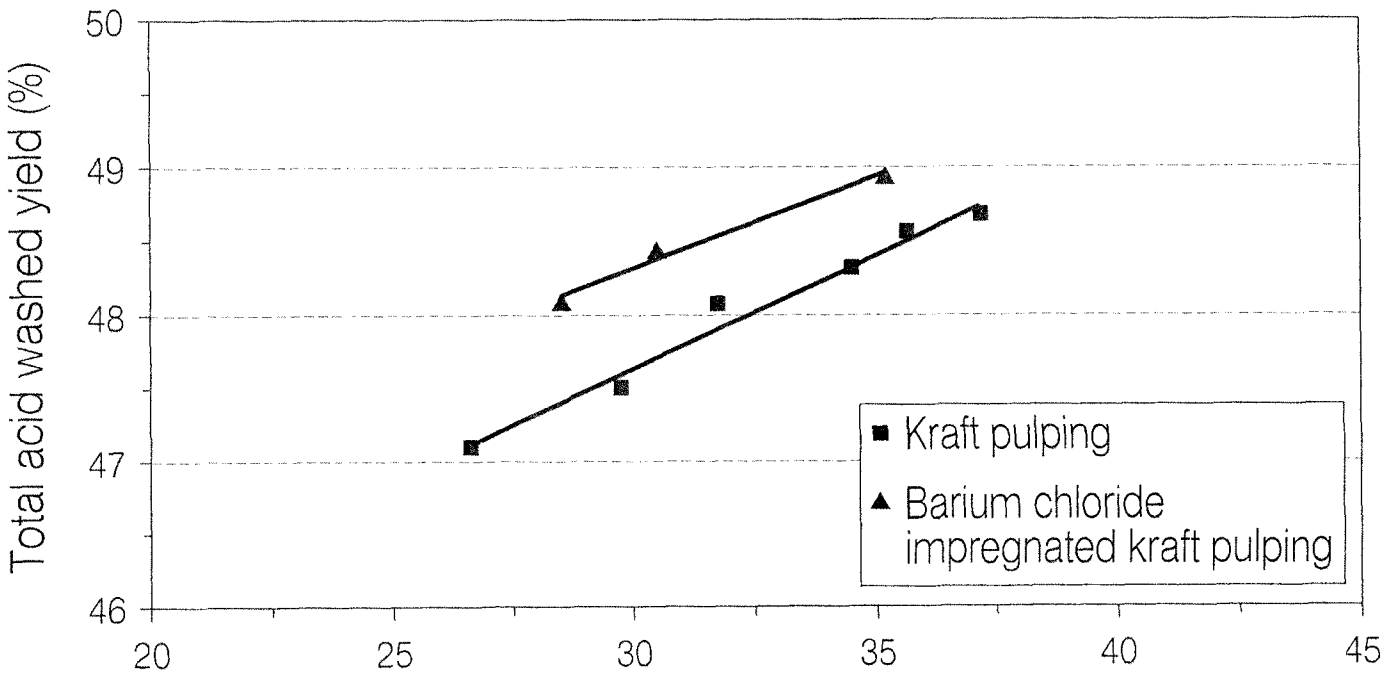
FIG. 6 shows a comparison of the pulping yield (% on oven dried wood) after acid washing for kraft pulping processes with and without barium chloride (1.1 g/L as Ba) in pre-impregnation stage; impregnation was done at room temperature for 16 hours.

By impregnating chips with barium chloride solution (1.1 g/L of Ba, the acid washed kraft pulping yield was increased by between 0.5% and 0.7% on wood at the same target kappa number in the kappa range of 27 to 36 (FIG. 6).

Example 7

Wood chip preparation: Wood chips of black spruce were classified and the 2 to 8 mm fraction was used. Chips containing any visible knots or bark were removed manually. The chips were passed through a steaming process at 138 kPa for 3 minutes and cooled to develop vacuum for 5 minutes.

Impregnation: The cooled chips (200 g o.d. basis) were immediately impregnated in 1.8 L of deionised water for the control samples or in calcium chloride solution (1.1 g/L of Ca) at room temperature for 15 minutes. The impregnation liquor was drained for 10 minutes to remove the excess liquor prior to kraft pulping.

Kraft cooking: Same as in example 1

Pulping yield determination: Same as in example 3

Figure 7:
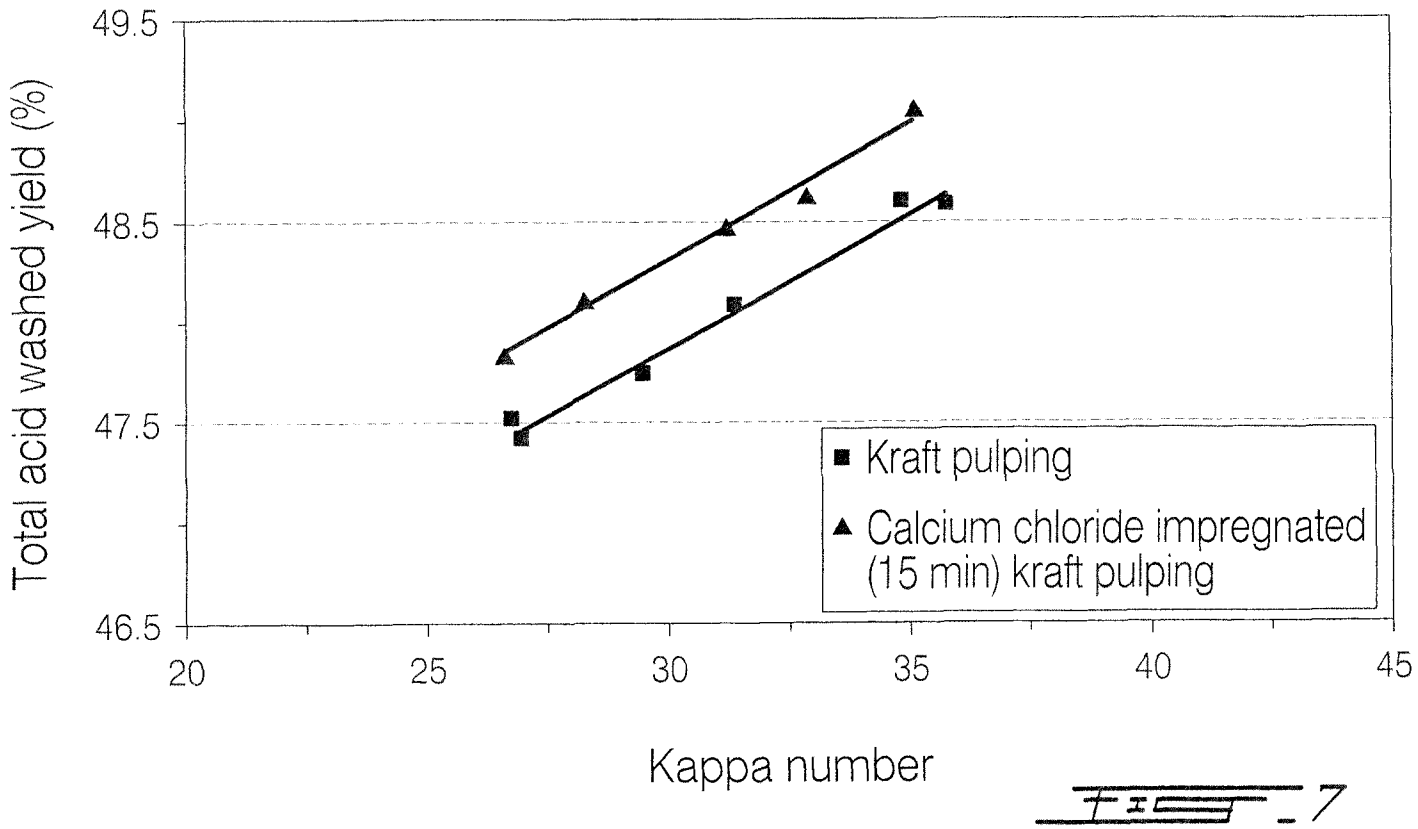
FIG. 7 shows a comparison of the pulping yield (% on oven dried wood) after acid washing for kraft pulping processes with and without calcium chloride (1.1 g/L as Ca) in a pre-impregnation stage; impregnation was done at room temperature for 15 minutes.

By impregnating chips with calcium chloride solution (1.1 g/L of Ca), the acid washed kraft pulping yield was increased 0.4%-0.5% on wood at the same target kappa number in the kappa range of 26 to 37 (FIG. 7).

Example 8

Wood chip preparation: Same as in example 1.

Impregnation: The chips (200 g o.d. basis) were impregnated in 1.8 L of deionised water for the control samples or in calcium chloride (1.1 g/L of Ca) and HEDP (0.22 g/L, active acid form) solution at room temperature for 16 hours. The impregnation liquor was drained over 10 minutes to remove the excess liquor prior kraft pulping.

Kraft cooking: Same as in example 1

Pulping yield determination: Same as in example 3

Figure 8:
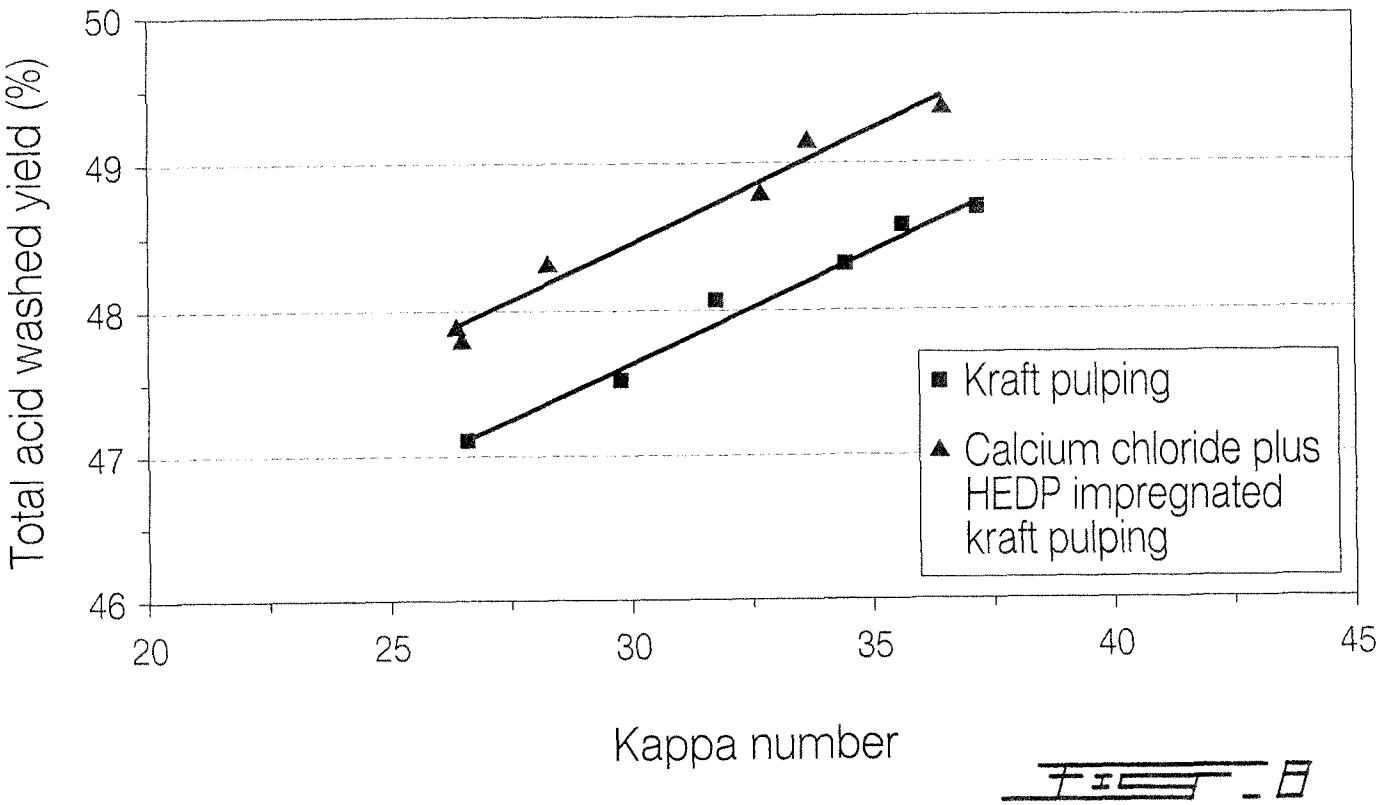
FIG. 8 shows a comparison of the pulping yield (% on oven dried wood) after acid washing for kraft pulping processes with and without calcium chloride (1.1 g/L as Ca) plus HEDP (0.22 g/L, active acid form) in a pre-impregnation stage; impregnation was done at room temperature for 15 minutes.

By impregnating chips with calcium chloride (1.1 g/L of Ca) and HEDP (0.22 g/L, active acid form), the acid washed kraft pulping yield was increased by between 0.7% and 0.8% on wood at the same target kappa number in the kappa range of 26 to 38 (FIG. 8).

References

1. Clayton, D. Svensk Papperstid. 69(9):311 (1966)
2. Aurell, R. Tappi 46(4): 209-215 (1963)
3. Procter, A. R., Styan, G. E., and Vinje, M. G., U.S. Pat. No. 3,841,962 (1974)
4. Smith, G. C. and Sanders, F. W., U.S. Pat. No. 4,024,229 (1977).
5. Dorris, G. M., U.S. Pat. No. 5,082,526 (1992).
6. Holton, H. H., U.S. Pat. No. 4,012,280 (1977).
7. Steltenkamp, S Can. Patent 1,196,156 (1985)
8. Steltenkamp. M. S., U.S. Pat. No. 4,507,172 (1985)
9. Phillips, R. B., U.S. Pat. No. 3,883,391 (1975)
10. Machell, G. Tappi 41(1): 12-16 (1958)
11. Fogarassy, A., U.S. Pat. No. 3,932,207 (1976)
12. Worster, H. E., U.S. Pat. No. 3,695,934 (1972)

The invention claimed is:

1. A method for increasing pulp yield in a reductive alkaline Kraft pulping of softwood chips, comprising:

introducing, as a sole pulp yield increasing additive, alkaline earth metal ions selected from the group consisting of calcium ions, barium ions and strontium, into said softwood chips, wherein said ions are in aqueous solution free of organic solvent;

digesting the softwood chips by Kraft cooking while stabilizing glucomannan in the softwood chips against alkali degradation with said alkaline earth metal ions to produce a Kraft pulp; and recovering the Kraft pulp in an increased yield as compared with digesting said softwood chips by Kraft cooking without said alkaline earth metal ions.

2. A method according to claim 1, wherein said softwood chips are impregnated with the alkaline earth metal ions prior to the reductive alkaline pulping.

3. A method according to claim 2, wherein said increased yield is 1.2 to 1.4%, by weight on the softwood chips.

4. A method according to claim 2, wherein said increased yield is 0.4 to 0.8%, by weight on the softwood chips.

5. A method according to claim 1, wherein said softwood chips are sprayed with the alkaline earth metal ions prior to the reductive alkaline pulping.

6. A method according to claim 1, wherein the reductive alkaline pulping is carried out in a Kraft pulping cooking liquor containing the alkaline earth metal ions in solution.

7. A method according to claim 6, wherein the alkaline earth metal ions are maintained in solution in the pulping liquor by a complexing agent for said ions, which prevents formation of insoluble salts of the alkaline earth metal ions.

8. A method according to claim 7, wherein the complexing agent is hydroxyethylidene diphosphonic acid (HEDP).

9. A method according to claim 7, wherein said digesting of the softwood chips in said Kraft pulping cooking liquor is in a reaction vessel to form said Kraft pulp, stabilizing the glucomannan of the softwood with said alkaline earth metal ions; and inhibiting formation of an insoluble scale on walls of the reaction vessel by the use of said complexing agent.

10. A method according to claim 6, wherein said increased yield is 0.6 to 0.8%, by weight on the softwood chips.

11. A method according to claim 1, wherein the alkaline earth metal ions are calcium ions.

12. A method according to claim 1, wherein said increased yield is 0.4 to 1.4%, by weight on the softwood chips.

13. A process for producing value products from softwood chips comprising:

subjecting softwood chips to acid hydrolysis to produce hydrolyzed softwood chips and a hemicellulose, recovering the hemicellulose, introducing, as a sole pulp yield increasing additive, alkaline earth metal ions selected from the group consisting of calcium ions, barium ions and strontium ions into the hydrolyzed softwood chips, wherein said ions are in aqueous solution free of organic solvent;

pulping the chips under reductive alkaline Kraft pulping conditions to produce a Kraft pulp in which the alkaline earth metal ions stabilize the glucomannan within the softwood chips against alkali degradation thereby enhancing pulp yield; and recovering the Kraft pulp in an increased yield as compared with pulping said softwood chips under Kraft pulping conditions without said alkaline earth metal ions.

14. A method according to claim 13, wherein the pulping is carried out in a Kraft pulping liquor containing the alkaline earth metal ions in solution, and the alkaline earth metal ions are maintained in the solution by a complexing agent for said ions, which prevents formation of insoluble salts of the alkaline earth metal ions.

15. A method according to claim 14, wherein the complexing agent is hydroxyethylidene diphosphonic acid (HEDP).

16. A method according to claim 14, wherein said pulping comprises digesting the softwood chips in said Kraft pulping liquor in a reaction vessel to form said Kraft pulp, stabilizing the glucomannan of the softwood chips with said alkaline earth metal ions; and inhibiting formation of an insoluble scale on walls of the reaction vessel by the use of said complexing agent.

17. A method according to claim 13, wherein the alkaline earth metal ions are calcium ions.

* * * * *